US007497941B2

(12) United States Patent
Germaine

(10) Patent No.: US 7,497,941 B2
(45) **Date of Patent: *Mar. 3, 2009**

(54) PROCESS TO PREPARE A LUBRICATING BASE OIL AND A GAS OIL

(75) Inventor: Gilbert Robert Bernard Germaine, Petit Couronne (FR)

(73) Assignee: Shell Oil Company, Houston, TX (US)

( * ) Notice: Subject to any disclaimer, the term of this patent is extended or adjusted under 35 U.S.C. 154(b) by 640 days.

This patent is subject to a terminal disclaimer.

(21) Appl. No.: 10/471,038

(22) PCT Filed: Mar. 5, 2002

(86) PCT No.: PCT/EP02/02451

§ 371 (c)(1),
(2), (4) Date: Sep. 4, 2003

(87) PCT Pub. No.: WO02/070627

PCT Pub. Date: Sep. 12, 2002

(65) Prior Publication Data

US 2004/0079678 A1 Apr. 29, 2004

(30) Foreign Application Priority Data

Mar. 5, 2001 (EP) ..... 01400563

(51) Int. Cl.
*C10G 47/02* (2006.01)

(52) U.S. Cl. ..... 208/60; 208/95; 208/96; 208/97; 208/108; 208/134; 208/143

(58) Field of Classification Search ..... 208/60, 208/95, 96, 97, 107, 33, 134
See application file for complete search history.

(56) References Cited

U.S. PATENT DOCUMENTS

| | | | | |
|---|---|---|---|---|
| 2,603,589 | A | 7/1952 | Schaerer | 196/17 |
| 3,876,522 | A | 4/1975 | Campbell | 208/58 |
| 3,965,018 | A | 6/1976 | Heilman et al. | 252/59 |

(Continued)

FOREIGN PATENT DOCUMENTS

AU 698392 10/1989

(Continued)

OTHER PUBLICATIONS

International Search Report dated Feb. 6, 2003.

(Continued)

*Primary Examiner*—Tam M. Nguyen

(57) ABSTRACT

A process to prepare two or more lubricating base oil grades and a gas oil by (a) hydrocracking/hydroisomerizing a Fischer-Tropsch product, wherein weight ratio of compounds having at least 60 or more carbon atoms and compounds having at least 30 carbon atoms in the Fischer-Tropsch product is at least 0.2 and wherein at least 30 wt % of compounds in the Fischer-Tropsch product have at least 30 carbon atoms;

(b) separating the product of step (a) into one or more gas oil fractions and a base oil precursor fraction;

(c) performing a pour point reducing step to the base oil precursor fraction obtained in step (b); and (d) separating the effluent of step (c) in two or more base oil grades.

11 Claims, 1 Drawing Sheet

U.S. PATENT DOCUMENTS

| | | | | |
|---|---|---|---|---|
| 4,299,714 | A | 11/1981 | Sugiura et al. | |
| 4,343,692 | A | 8/1982 | Winquist | 208/111 |
| 4,574,043 | A | 3/1986 | Chester et al. | |
| 4,582,616 | A | 4/1986 | Kita et al. | |
| 4,859,311 | A | 8/1989 | Miller | |
| 4,919,788 | A | 4/1990 | Chen et al. | 208/59 |
| 4,943,672 | A | 7/1990 | Hamner et al. | 585/727 |
| 4,983,273 | A | 1/1991 | Kennedy et al. | 208/89 |
| 5,053,373 | A | 10/1991 | Zones | |
| 5,059,299 | A | 10/1991 | Cody et al. | 208/27 |
| 5,135,638 | A | 8/1992 | Miller | 208/27 |
| 5,157,191 | A | 10/1992 | Bowes et al. | |
| 5,362,378 | A | 11/1994 | Borghard et al. | 208/138 |
| 5,370,818 | A | 12/1994 | Schleifstein | |
| 5,372,703 | A | 12/1994 | Kamiya et al. | 208/58 |
| 5,447,621 | A | 9/1995 | Hunter | 208/58 |
| 5,456,820 | A | 10/1995 | Forbus, Jr. et al. | 208/111 |
| 5,693,598 | A | 12/1997 | Abraham et al. | 508/444 |
| 5,723,716 | A | 3/1998 | Brandes et al. | 585/734 |
| 5,770,542 | A | 6/1998 | Brandes et al. | 502/527 |
| 5,785,862 | A | 7/1998 | Graham et al. | |
| 5,804,058 | A | 9/1998 | Grandvallet et al. | 208/171 |
| 5,856,365 | A | 1/1999 | Zennaro et al. | 518/715 |
| 5,935,417 | A | 8/1999 | Cody et al. | 208/87 |
| 6,059,955 | A | 5/2000 | Cody et al. | 208/18 |
| 6,060,437 | A | 5/2000 | Robson et al. | 508/371 |
| 6,090,989 | A | 7/2000 | Trewella et al. | 585/13 |
| 6,103,099 | A | 8/2000 | Wittenbrink et al. | 208/27 |
| 6,165,949 | A | 12/2000 | Habeeb et al. | |
| 6,627,779 | B2 | 9/2003 | O'Rear | 585/302 |
| 6,642,189 | B2 | 11/2003 | Kurihara et al. | 508/364 |
| 2003/0119682 | A1 | 6/2003 | Saini et al. | 508/167 |
| 2004/0099571 | A1 | 5/2004 | Germaine et al. | 208/108 |
| 2004/0118744 | A1 | 6/2004 | Daniel et al. | 427/512 |
| 2004/0192979 | A1 | 9/2004 | Matthai et al. | 585/16 |

FOREIGN PATENT DOCUMENTS

| | | | |
|---|---|---|---|
| EP | A-0113579 | | 7/1984 |
| EP | 237655 | | 9/1987 |
| EP | 323092 | | 7/1989 |
| EP | 0426223 | | 5/1991 |
| EP | 471524 | | 2/1992 |
| EP | 0237655 | | 6/1992 |
| EP | 0532118 | | 3/1993 |
| EP | 0776959 | | 6/1997 |
| EP | B-668342 | | 8/1999 |
| EP | 0832171 | | 1/2000 |
| EP | 0666894 | | 11/2000 |
| EP | 1102827 | | 9/2002 |
| EP | 1365005 | A | 11/2003 |
| EP | 1389635 | A | 2/2004 |
| EP | 1370633 | | 8/2005 |
| EP | 1366134 | | 11/2005 |
| GB | 713910 | | 8/1954 |
| JP | 401133988 | A | 5/1989 |
| WO | 94/10263 | | 5/1994 |
| WO | WO199410263 | | 5/1994 |
| WO | WO 95/23765 | | 9/1995 |
| WO | WO199603359 | | 2/1996 |
| WO | 97/18278 | | 5/1997 |
| WO | WO199721788 | | 6/1997 |
| WO | WO199802503 | | 1/1998 |
| WO | WO199920720 | | 4/1999 |
| WO | 99/34917 | | 7/1999 |
| WO | 00/14179 | | 3/2000 |
| WO | 00/14184 | | 3/2000 |
| WO | WO200014183 | | 3/2000 |
| WO | WO200014187 | | 3/2000 |
| WO | WO200014188 | | 3/2000 |
| WO | WO200015736 | | 3/2000 |
| WO | 00/29511 | | 5/2000 |
| WO | WO200107469 | | 2/2001 |
| WO | WO200107538 | | 2/2001 |
| WO | WO200118156 | | 3/2001 |
| WO | WO200157166 | | 8/2001 |
| WO | WO2001074969 | | 11/2001 |
| WO | WO2002064710 | | 8/2002 |
| WO | WO2002064711 | | 8/2002 |
| WO | WO2002070627 | | 9/2002 |
| WO | WO2002070629 | | 9/2002 |
| WO | WO2002070630 | | 9/2002 |
| WO | WO2002096842 | | 12/2002 |

OTHER PUBLICATIONS

Lubricant Base Oil and Wax Processing, Avilino Sequeira, Jr., Marcel Dekker Inc., New York 1994, Chapter 7.

Kirk-Othmer Encyclopedia of Chemical Technology, 3rd edition, vol. 14, pp. 477-526.

Extract from web-site http://www.deh.gov.au. providing a summary of the development of the European Union fuel standard through the years 1993 and 2000 (so-called "Euro-2" and "Euro-3" respectively) and beyond. for petrol (gasoline) and diesel fuel.

Introduction to Organic Laboratory Techniques. D L Pavia et al. 1976. pp. 614-625.

Sie, S. T. et al, "Conversion of Natural Gasto transportation Fuels Via the Shell Middle Distillate Synthesis Process (SMDS)". Catalysis Today. vol. 8. 1991. pp. 371-394.

M.M.G. Senden, "The Shell Middle Distillate Synthesis Process: Commercial plant experience and outlook into the future", Petrole et Techniques. Aasociation Francaise Des Technic. Paris. Fr., No. 415. Jul. 1998. XP00)771962. pp. 94-97.

Letter dated 14th Jun. 2004 from Shell to EPO on EP 02726138.7-2104 reference has no date.

Avilino Sequeira, Jr., Marchel Dekker Inc. "Lubricant Base Oil and Wax Processing". New York 1994, pp. 162-165.

Peter J.A. Tijm. Shell Intl Gas Ltd. Alternative Energy 1995, "The Markets for Shell Middle Distillate Synthesis Products", Vancouver. Canada. May 2-4, 1995.

Shell MDS (Malaysia) "Manufacturing Clean Products From Natural Gas". May 1995.

Lewis, Sr., Richard J.: Hawley's Condensed Chemical Dictionary. 14th Ed., John Wiley & Sons. New York. 2001 (p. 228).

Ballard. D. H., Generalizing the Hough Transformation to Detect Arbitrary Shapes. Pattern Recognition. vol. 13, No. 2. pp. 111-122. 1981.

Z. Liang & C. S. Hsu. "Molecular Speciation of Saturates by On-Line Liquid Chromatography-Field Ionization Mass Spectrometry", Energy & Fuel, Apr. 1998.

Affidavit of John Rosenbaum dated Nov. 4, 2004, filed in connection with opposition proceedings on EP-B-1102827.

1996 exchange of correspondance between Chevron and Shell Malaysia.

1996 sales invoice of waxy raffinate to Bentley Chemplax (Australia).

Bill from Showa Shell to General Sekiyu dated Jun. 12, 1997.

Affidavit of Mr. Masami Sakaguchi dated Jun 17, 2004.

Internal Showa Shell note dated Oct. 17, 1996 re shipment of Process Oil 123X.

1993 Showa Shell brochure on XHVI.

Sample Request Form for waxy raffinate Jul. 1996.

R.M. Mortier & S. T. Orszulik. "Chemistry and Technology of Lubricants". 2nd Ed.. pp. 4-5. 1997.

SAE Surface Vehicle Standard J300. Rev. Dec. 1999. J. Mass Spectrometry. vol. 31. 383-388 (1996). Klesper & Rollgen.

Lucie Coniglio and Armelle Nouviaire "A Method for Estimating the Normal Boiling Point of Heavy Hydrocarbons Suitable for a Group-Contribution-Based Equation of State", published in 2001 by the American Chemical Society. Incl. Eng. Chem. Res. 2001. 40. 1781-1790.

PROCESS TO PREPARE A LUBRICATING BASE OIL AND A GAS OIL

FIELD OF THE INVENTION

The invention is directed to a process to prepare a lubricating base oil and a gas oil from a Fischer-Tropsch product.

BACKGROUND OF THE INVENTION

Such a process is known from EP-A-776959. This publication describes a process wherein the high boiling fraction of a Fischer-Tropsch synthesis product is first hydroisomerised in the presence of a silica/alumina supported Pd/Pt catalyst. The isomerised product having a content of non-cyclic iso-paraffins of more than 80 wt % is subsequently subjected to a pour point reducing step. The disclosed pour point reducing step in one of the examples is a catalytic dewaxing step performed in the presence of a silica supported dealuminated ZSM-23 catalyst at 310° C.

A disadvantage of such a process is that only one grade of base oils is prepared. A next disadvantage is that the hydrosiomerisation step is performed on a narrow boiling range fraction of a Fischer-Tropsch synthesis product, which hydroisomerisation step is especially directed to prepare a base oil precursor fraction having the desired properties. The hydroisomerisation process step can also yield valuable middle distillates next to base oil precursor fractions if the feed would also include more lower boiling compounds. There is thus a desire to prepare base oils from a waxy paraffinic fraction as obtainable from a hydroisomerisation process step which yields both middle distillates, such as naphtha, kerosine and gas oil, and the waxy paraffinic fraction having a content of non-cyclic iso-paraffins of more than 90 wt %. There is also a desire to have a flexible process wherein two or more base oils having different viscosity properties are obtained of excellent quality.

WO-A-0014184 discloses a process to simultaneously prepare a gas oil and a base oil from a Fischer-Tropsch wax by hydro-isomerisation followed by catalytic dewaxing. The examples illustrate how a Fischer-Tropsch wax having almost no molecules having more than 60 carbon atoms is used as feed. A feature of this process is that the cold flow properties of the gas oil fraction could be improved.

U.S. Pat. No. 6,165,949 discloses a process wherein starting from the same FischerTropsch feed as illustrated in the above WO-A-0014184 a relatively low viscosity base oil is prepared by hydro-isomerisation and catalytic dewaxing. The base oil having a kinematic viscosity at 100° C. of 4.83 cSt is used in a wear resistant lubricant formulation.

SUMMARY OF THE INVENTION

The object of the present invention is to provide a process wherein a high yield to gas oils is achieved and wherein two or more high quality base oils are prepared having different viscosities from a waxy Fischer-Tropsch product.

This object is achieved by the following process. Process to prepare two or more lubricating base oil grades and a gas oil by (a) hydrocracking/hydroisomerisating a Fischer-Tropsch product, wherein weight ratio of compounds having at least 60 or more carbon atoms and compounds having at least 30 carbon atoms in the Fischer-Tropsch product is at least 0.2 and wherein at least 30 wt % of compounds in the Fischer-Tropsch product have at least 30 carbon atoms, (b) separating the product of step (a) into one or more gas oil fractions and a base oil precursor fraction, (c) performing a pour point reducing step to the base oil precursor fraction obtained in step (b), and (d) separating the effluent of step (c) in two or more base oil grades.

BRIEF DESCRIPTION OF THE DRAWINGS

The FIGURE shows a preferred embodiment of the process according to the present invention.

DETAILED DESCRIPTION OF THE INVENTION

Figure 1:
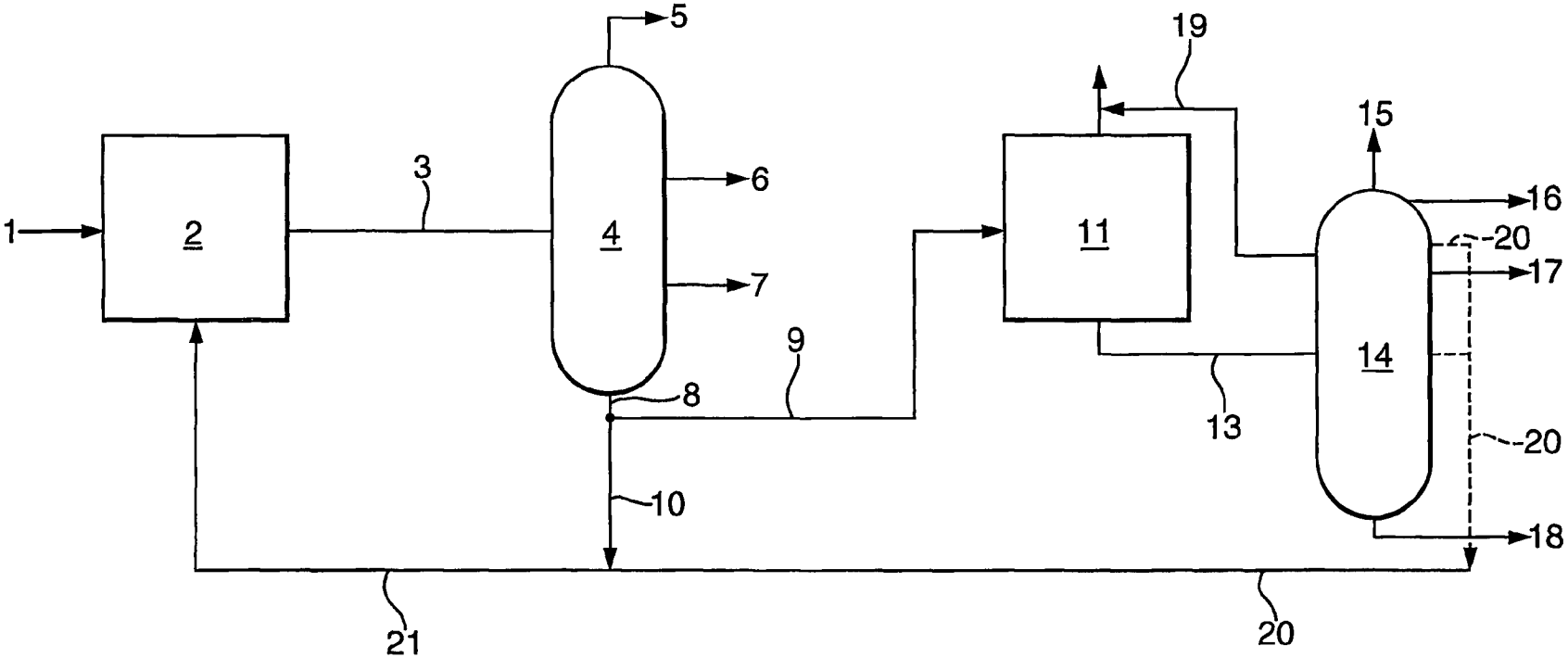

Applicants found that by performing the hydro-cracking/hydroisomerization step with the relatively heavy feedstock a higher yield of gas oils as calculated on the feed to step (a) can be obtained. A further advantage is that both fuels, for example gas oil, and material suited for preparing base oils are prepared in one hydrocracking/hydroisomerization process step. This line up is more simple than a line up wherein a dedicated base oil hydrocracking/hydroisomerization step is performed on a Fischer-Tropsch wax boiling mainly above 370° C. as described in for example WO-A-0014179 hereby incorporated by reference. Another advantage is that two or more base oil grades having different kinematic viscosities at 100° C. ranging from about 2 cSt to above 12 cSt can be prepared simultaneously.

A further advantage is that base oils are prepared having a relatively high content of cyclo-paraffins, which is favourable to achieve desired solvency properties. The content of cyclo-paraffins in the saturates fraction of the obtained base oil may be between 5 and 40 wt %. Base oils having a cyclo-paraffin content in the saturates fraction of between 12 and 20 wt % have been found to be excellent base stocks to formulate motor engine lubricants.

The process of the present invention also results in middle distillates having exceptionally good cold flow properties. These excellent cold flow properties could perhaps be explained by the relatively high ratio iso/normal and especially the relatively high amount of di- and/or trimethyl compounds. Nevertheless, the cetane number of the diesel fraction is more than excellent at values far exceeding 60, often values of 70 or more are obtained. In addition, the sulphur content is extremely low, always less than 50 ppmw, usually less than 5 ppmw and in most case the sulphur content is zero. Further, the density of especially the diesel fraction is less than 800 kg/m$^3$, in most cases a density is observed between 765 and 790 kg/m$^3$, usually around 780 kg/m$^3$ (the viscosity for such a sample being about 3.0 cSt). Aromatic compounds are virtually absent, i.e. less than 50 ppmw, resulting in very low particulate emissions. The polyaromatic content is even much lower than the aromatic content, usually less than 1 ppmw. T95, in combination with the above properties, is below 380° C., often below 350° C.

The process as described above results in middle distillates having extremely good cold flow properties. For instance, the cloud point of any diesel fraction is usually below −18° C., often even lower than −24° C. The CFPP is usually below −20° C., often −28° C. or lower. The pour point is usually below —18° C., often below −24° C.

The relatively heavy Fischer-Tropsch product used in step (a) has at least 30 wt %, preferably at least 50 wt % and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}^{+}$ fraction having an ASF-alpha value (Anderson-Schulz-Flory chain growth factor) of at least 0.925, preferably at least 0.935, more preferably at least 0.945, even more preferably at least 0.955. The initial boiling point of the Fischer-Tropsch product is preferably below 200° C. Preferably any compounds having 4 or less carbon atoms and any compounds having a boiling point in that range are separated from a Fischer-Tropsch synthesis product before being used in step (a). The Fischer-Tropsch product as described in detail above is a Fischer-Tropsch product which has not been subjected to a hydroconversion step as defined according to the present invention. The content of non-branched compounds in the Fischer-Tropsch product will therefore be above 80 wt %. In addition to the Fischer-Tropsch product also other fractions may be additionally processed in step (a). Possible other fractions to be fed to step (a) may suitably be part of the base oil precursor fraction which cannot be processed in step (c) and/or off-spec base oil fractions as obtained in step (d).

Such a Fischer-Tropsch product can be obtained by any process which yields a relatively heavy Fischer-Tropsch product. Not all Fischer-Tropsch processes yield such a heavy product. An example of a suitable Fischer-Tropsch process is described in WO-A-9934917 and in AU-A-698392 both of which are hereby incorporated by reference. These processes may yield a Fischer-Tropsch product as described above.

The Fischer-Tropsch product will contain no or very little sulphur and nitrogen containing compounds. This is typical for a product derived from a Fischer-Tropsch reaction which uses synthesis gas containing almost no impurities. Sulphur and nitrogen levels will thus generally be below 1 ppmw respectively.

The Fischer-Tropsch product may be obtained by subjecting the reaction product of the Fischer-Tropsch reaction to a mild hydrotreatment step in order to remove any oxygenates and saturate any olefinic compounds. Such a hydrotreatment is described in EP-B-668342. The mildness of the hydrotreating step is preferably expressed in that the degree of conversion in this step is less than 20 wt % and more preferably less than 10 wt %. The conversion is here defined as the weight percentage of the feed boiling above 370° C., which reacts to a fraction boiling below 370° C. After such a mild hydrotreatment lower boiling compounds, having four or less carbon atoms and other compounds boiling in that range, will preferably be removed from the effluent before it is used in step (a) as the above described Fischer-Tropsch product.

The hydrocracking/hydroisomerisation reaction of step (a) is preferably performed in the presence of hydrogen and a catalyst, known to one skilled in the art as being suitable for this reaction. Catalysts for use in step (a) typically comprise an acidic functionality and a hydrogenation/dehydrogenation functionality. Preferred acidic functionalities are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. If desired, applying a halogen moiety, in particular fluorine, or a phosphorous moiety to the carrier, may enhance the acidity of the catalyst carrier.

Preferred hydrogenation/dehydrogenation functionalities are Group VIII noble metals, for example palladium and more preferably platinum. The catalyst may comprise the hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art. Examples of suitable hydrocracking/hydroisomerization processes and suitable catalysts are described in WO-A-0014179, EP-A-532118, EP-A-666894 and the earlier referred to EP-A-776959 all of which are hereby incorporated by reference.

In step (a) the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bara and preferably between 20 and 80 bara. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 70 wt %. The feed as used above in the definition is the total hydrocarbon feed fed to step (a), including for example any recycle streams.

In step (b) the product of step (a) is separated into one or more gas oil fractions and a base oil precursor fraction. The base oil fraction will suitably have an initial boiling point of between 330 and 400° C. The separation is preferably performed by means of a distillation at about atmospheric conditions, preferably at a pressure of between 1.2-2 bara, wherein the gas oil product and lower boiling fractions, such as naphtha and kerosine fractions, are separated from the higher boiling fraction of the product of step (a).

In step (c) the base oil precursor fraction obtained in step (b) is subjected to a pour point reducing treatment. With a pour point reducing treatment is understood every process wherein the pour point of the base oil is reduced by more than 10° C., preferably more than 20° C., more preferably more than 25° C.

The pour point reducing treatment can be performed by means of a so-called solvent dewaxing process or by means of a catalytic dewaxing process. Solvent dewaxing is well known to those skilled in the art and involves admixture of one or more solvents and/or wax precipitating agents with the base oil precursor fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

Preferably step (c) is performed by means of a catalytic dewaxing process. With such a process it has been found that base oils having a pour point of below −40° C. can be prepared when starting from a base oil precursor fraction as obtained in step (b) of the present process.

The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of a base oil precursor fraction under catalytic dewaxing conditions. Preferably the intermediate pore size zeolites have a pore diameter of between 0.35 and 0.8 nm. Suitable intermediate pore size zeolites are ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311 hereby incomorated by reference. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat Nos. 5,053,373, 5,252,527 and 4,574,043 all of which are hereby incorporated by reference.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina is used. Examples of these binder materials are as silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosiicate salt as described in for example U.S. Pat. No. 5,157,191 or WO-A-0029511 both of which are hereby incorporated by reference. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171 both of which are hereby incorporated by reference.

Catalytic dewaxing conditions are known in the art and typically involve operating temperatures in the range of from 200 to 500° C., suitably from 250 to 400° C., hydrogen pressures in the range of from 10 to 200 bar, preferably from 40 to 70 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 litres of hydrogen per litre of oil. By varying the temperature between 275 and more preferably between 315 and 375° C. at between 40-70 bars, in the catalytic dewaxing step it is possible to prepare base oils having different pour point specifications varying suitably from below −60 up to −10° C.

The effluent of step (c) is optionally subjected to an additional hydrogenation step prior to step (d) or after performing step (d), also referred to as a hydrofinishing step for example if the effluent contains olefins or when the product is sensitive to oxygenation or when colour needs to be improved. This step is suitably carried out at a temperature between 180 and 380° C., a total pressure of between 10 to 250 bar and preferably above 100 bar and more preferably between 120 and 250 bar. The WHSV (Weight hourly space velocity) ranges from 0.3 to 2 kg of oil per litre of catalyst per hour (kg/l.h).

The hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten. Suitable carrier or support materials are amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Examples of suitable hydrogenation catalysts are nickel-molybdenum containing catalyst such as KF-847 and KF-8010 (AKZO Nobel) M-8-24 and M-8-25 (BASF), and C-424, DN-190, HDS-3 and HDS-4 (Criterion); nickel-tungsten containing catalysts such as NI-4342 and NI-4352 (Engelhard) and C-454 (Criterion); cobalt-molybdenum containing catalysts such as KF-330 (AKZO-Nobel), HDS-22 (Criterion) and HPC-601 (Engelhard). Preferably platinum containing and more preferably platinum and palladium containing catalysts are used. Preferred supports for these palladium and/or platinum containing catalysts are amorphous silica-alumina. Examples of suitable silica-alumina carriers are disclosed in WO-A-9410263 hereby incorporated by reference. A preferred catalyst comprises an alloy of palladium and platinum preferably supported on an amorphous silica-alumina carrier of which the commercially available catalyst C-624 of Criterion Catalyst Company (Houston, Tex.) is an example.

In step (d) lower boiling non-base oil fractions are suitably first removed, preferably by means of distillation, optionally in combination with an initial flashing step. After removal of these lower boiling compounds the dewaxed product is separated, suitably by means of distillation, into two or more base oil grades. In order to meet the desired viscosity grades and volatility requirements of the various base oil grades preferably off-spec fractions boiling between, above and/or below the desired base oil grades are also obtained as separate fractions. These fractions may advantageously be recycled to step (a) if they have an initial boiling point of above 340° C. Any fractions obtained boiling in the gas oil range or below may suitably be recycled to step (b) or alternatively directly blended with the end gas oil product. The separation into the various fractions may suitably be performed in a vacuum distillation column provided with side stripers to separate the fraction from said column.

FIG. 1 shows a preferred embodiment of the process according to the present invention. To a hydrocracker reactor (2) a Fischer-Tropsch product (1) is fed. After separation of gaseous products the effluent (3) is separated into a naphtha fraction (5), a kerosene fraction (6), a gas oil fraction (7) and a base oil precursor fraction (8). Part of this fraction (8) is recycled via (10) and (21) to reactor (2) and part is fed to dewaxing reactor (11), usually a packed bed reactor, via (9).

An intermediate product (13) is obtained by separating the gaseous fraction and part of the gas oil fraction and those compounds boiling within that range (12), which are formed during the catalytic dewaxing process, from the effluent of reactor (11). Intermediate product (13) is fed to a vacuum distillation column (14), which column (14) is provided with means, e.g. side strippers, to discharge along the length of the tower different fractions boiling between the top and bottom distillation products. In FIG. 1 tops (15), a gas oil fraction (19), a light base oil grade (16), an intermediate base oil grade (17) and a heavy base oil grade (18) are obtained as distillate products of column (17) In order to meet volatility requirements of grades (17) and (18) intermediate fractions (20) are withdrawn from the column and recycled via (21) to hydrocracker (2). Gas oil fractions obtained as (12) and (19) may be recycled to distillation column (4). Alternatively it may also be possible that the bottom distillate product of column (14) cannot be used as a base oil grade. In such a situation the bottom distillate product is suitably recycled to reactor (2) (not shown).

The process according to the invention can be suitably applied to simultaneously prepare the following base oil grades, (i) base oils having a kinematic viscosity at 100° C. (vK @ 100) of between about 2 and 4 cSt suitable for electrical oils, (ii) base oils of vK @ 100 between about 2 and 15 cSt suitable for refrigerator oils and/or (iii) base oils having a vK @ 100 of between about 2 and up to 30 cSt suitable for process oil applications or as medicinal white oil applications. Especially base oils having a vK @ 100 of between 12 and 30 cSt may be prepared having a VI of above 125 and an evaporation loss after 1 hour at 250° C. of at most 0.5 wt %. Such novel base oils may find use as plasticizers or as a mould release process oil. Such a mould release agent may find advantageous use in food packaging applications.

The base oil as obtainable by the process according to the invention can be advantageously find use in electrical and refrigerator oils, because of its low pour point. Especially the grades having a pour point of below −40° C. are very suited. The base oils as obtained by the present invention are furthermore advantageous for this use because of their higher resistance to oxidation compared to low pour point naphthenic type base oils which are presently used.

Medicinal white oils having a vK @ 100 in the range 4 to 25 cSt, preferably 6 to 9 cSt, can be blended using a base oils as obtained by the above process. UV spectroscopy has shown that these base oils have excellent potential to meet US Food and Drug Administration FDA§178.3620 b and FDA§178.3620 c requirements.

Process oils and especially cutting oils are preferably based on these base oils because less additives are required to formulate the process oil. Additives are to be avoided as much as possible in these applications due to the fact that process oils frequently come into contact with the skin of persons operating machines, for example a cutting machine, in which the process oil is used. Additives can give rise to skin irritation when the process oil comes into contact with the skin of the operator.

The base oils can also be advantageously used in a turbine or hydraulic fluid. The very highly inhibited oxidative stability needed for such applications can be achieved by using the base oils obtainable by the process of this invention in combination with supplementary antioxidants. Preferred antioxidants are of the aminic or hindered phenolic type.

Other base oils obtainable by the above process include base oils suitable for automatic transition fluids (ATF). Preferably a base oil is used having a low pour point of below −40° C. as obtainable when step (c) is performed by means of catalytic dewaxing. Base oils having a vK @ 100 of about 4 cSt can be optionally blended with a grade having a vK @ 100 of about 2 cSt to obtain a base oil suitable for an ATF. The lower viscosity base oil, having a kinematic viscosity of about 2 to 3 cSt, can suitably be obtained by catalytic dewaxing of a suitable gas oil fraction as obtained in the atmospheric and/or vacuum distillation in step (b). The Automatic Transmission Fluid will comprise the base oil as described above, preferably having a vK @ 100 of between 3 and 6 cSt, and one or more performance additives. Examples of such performance additives are an antiwear agent, an antioxidant, an ashless dispersant, a pour point depressant, and antifoam agent, a friction modifier, a corrosion inhibitor and a viscosity modifier.

The base oils obtained by the present process having vK @ 100 values of between 2 and 9 cSt, are also suitable for use in automotive engine oils. Especially the base oils having the very low pour points, suitably lower than −40° C., have been found to be very suitable for use in lubricant formulations such as high performance gasoline engine oils of the 0W-xx specification according to the SAE J-300 viscosity classification, wherein xx can be 20, 30, 40, 50, 60. It has been found that these high tier lubricant formulations can be prepared with the base oils obtainable by the process of the current invention. Other automotive engine oil applications are the 5W-xx and the 10W-xx formulations, wherein the xx is as above. The automotive engine oil formulation will suitably comprise one or more of the above described base oil(s) and one or more additives. Examples of additive types which may form part of the composition are ashless dispersants, detergents, preferably of the over-based type, viscosity modifying polymers, extreme pressure/antiwear additives, preferably of the zinc dialkyl dithiophosphate type (ZDTP), antioxidants, preferably of the hindered phenolic or aminic type, pour point depressants, emulsifiers, demulsifiers, corrosion inhibitors, rust inhibitors, antistaining additives and/or friction modifiers. Specific examples of such additives are described in for example Kirk-Othmer Encyclopedia of Chemical Technology, third edition, volume 14, pages 477-526.

Food approved white oils can also be suitably based on the base oil grades as obtained by the present process. The base oils are very suitable for such an application because of the absence or very low content of unsaturated cyclic molecules in the base oil.

Greases may also be based on these base oils because it seems that more soap thickeners can be included, as compared to when conventional high viscosity index base oils are used, in order to arrive at the same desired grease viscosity specifications. Increased thickener inclusion is advantageous because it results in greases of higher high temperature mechanical stability. Thus with the base oils as obtainable by the present process it has been found possible to formulate greases with a low pour point and an improved high temperature mechanical stability. These greases furthermore have an enhanced inhibited oxidational stability.

The invention will be illustrated with the following non-limiting example.

EXAMPLE 1

The $C_5$-C750° C.$^+$ fraction of the Fischer-Tropsch product, as obtained in Example VII using the catalyst of Example III of WO-A-9934917, was continuously fed to a hydrocracking step (step (a)). The feed contained about 60 wt % $C_{30}$+ product. The ratio $C_{60}$+/$C_{30}$+ was about 0.55. In the hydrocracking step the fraction was contacted with a hydrocracking catalyst of Example 1 of EP-A-532118. The effluent of step (a) was continuously distilled under vacuum to give lights, fuels and a residue "R" boiling from 370° C. and above. The yield of gas oil fraction on fresh feed to hydrocracking step was 43 wt %. The properties of the gas oil thus obtained are presented in Table 3.

The main part of the residue "R" was recycled to step (a) and a remaining part was sent to a catalytic dewaxing step (c). The conditions in the hydrocracking step (a) were: a fresh feed Weight Hourly Space Velocity (WHSV) of 0.8 kg/l.h, recycle feed WHSV of 0.25 kg/l.h, hydrogen gas rate=1000 Nl/kg, total pressure=40 bar, and a reactor temperature of 335° C.

In the dewaxing step, the fraction described above boiling from 370° C. to above 750° C. was contacted with a dealuminated silica bound ZSM-5 catalyst comprising 0.7% by weight Pt and 30 wt % ZSM-5 as described in Example 9 of WO-A-0029511. The dewaxing conditions were 40 bar hydrogen, WHSV=1 kg/l.h and a temperature of 355° C.

The dewaxed oil was distilled into three base oil fractions boiling between 305 and 410° C. (yield based on feed to dewaxing step was 13.4 wt %), between 410-460° C. (yield based on feed to dewaxing step was 13.6 wt %) and a fraction boiling above 510° C. (yield based on feed to dewaxing step was 41.2 wt %).

The base oil fraction boiling between 410 and 460° C. and the fraction boiling between 305 and 410° C. were analysed in more detail (see Table 1). From Table 1 it can be seen that a base oil according to the API Group III specifications was obtained.

TABLE 1

| | Grade 3 | Grade 4 |
|---|---|---|
| density at 20° C. | 805.5 | 814.5 |
| pour point (° C.) | −54 | −48 |
| kinematic viscosity at 40° C. (cSt) | 9.05.4 | 17.99 |
| kinematic viscosity at 100° C. (cSt) | 3.0 | 4.011 |
| VI | 103 | 122 |
| sulphur content (% w) | <0.001 | <0.001 |
| saturates (% w) | >95 | |

EXAMPLE 2

Example 1 was repeated except that the dewaxing temperature was 365° C. The dewaxed oil was distilled into three base oil fractions boiling between 305 and 420° C. (yield based on feed to dewaxing step was 16.1 wt %), between 420-510° C. (yield based on feed to dewaxing step was 16.1 wt %) and a fraction boiling above 510° C. (yield based on feed to dewaxing step was 27.9 wt %). The base oil fraction boiling between 420 and 510° C. and the heavier fraction was analysed in more detail (see Table 2).

TABLE 2

| | Grade 5 | Heavy Grade |
|---|---|---|
| density at 20° C. | 818.5 | 837.0 |
| pour point (° C.) | −59 | +9 |
| kinematic viscosity at 40° C. (cSt) | 24.5 | |
| kinematic viscosity at 100° C. (cSt) | 4.9 | 22.92 |
| VI | 128 | 178 |
| sulphur content (% w) | <0.001 | <0.001 |
| saturates (% w) | >95 | |

EXAMPLE 3-4

Example 1 was repeated except that the temperature in step (a) was varied (see Table 3). The gas oil fraction was further analysed (see Table 3). Cloud point, Pour point and CFPP were determined by ASTM D2500, ASTM D97 and IP 309-96 respectively. Establishment of the $C_5$+, $C_{30}$+ and $C_{60}$+ fractions were done by gas chromatography.

COMPARATIVE EXAMPLE A AND B

Example 1 was repeated (Experiment A) starting from a Fischer Tropsch material made with a cobalt/zirconia/silica catalyst as described in EP-A-426223. The $C_5$+ fraction contained about 30 wt % $C_{30}$+ product, the ratio $C_{60}$+/$C_{30}$+ was 0.19. Experiment B was performed as Experiment A except that the reaction temperature in step (a) was different (See Table 3). The properties of the gas oil fractions are summarised in Table 3.

TABLE 3

| Example | 3 | 1 | 4 | A | B |
|---|---|---|---|---|---|
| Temperature | 330 | 335 | 340 | 330 | 335 |
| Cloud Point | −13 | −20 | <−24 | +1 | −2 |
| CFPP | −14 | −21 | −28 | 0 | −5 |
| Pour Point | −18 | <−24 | <−24 | 0 | −6 |
| Normals (wt %) | 27.6 | 21.3 | 19.9 | 50.4 | 41.2 |
| Iso's (wt %) | 72.4 | 78.7 | 80.1 | 49.6 | 58.8 |
| Mono-methyl | 37.3 | 39.5 | 39.5 | 29.2 | 32.2 |
| Di-methyl | 21.7 | 25.5 | 26.7 | 13.9 | 18.1 |
| Others | 13.4 | 13.8 | 14.1 | 6.4 | 8.5 |
| Density (kg/l) | 0.78 | 0.78 | 0.78 | 0.78 | 0.78 |
| Cetane (D976m) | 78 | 77 | 76 | 80 | 78 |
| Cetane (D4737m) | 87 | 85 | 86 | 90 | 85 |
| T95 | 363 | 360 | 358 | — | — |

We claim:

1. A process to prepare two or more lubricating base oil grades and a gas oil comprising:

(a) hydrocracking or hydroisomerizing a Fischer-Tropsch product, wherein a weight ratio of compounds having at least 60 or more carbon atoms and compounds having at least 30 carbon atoms in the Fischer-Tropsch product is at least 0.2 and wherein at least 30 wt % of compounds in the Fischer-Tropsch product have at least 30 carbon atoms to produce a hydrocracking or hydroisomerizing product;

(b) separating the hydrocracking or hydroisomerizing product of step (a) into one or more gas oil fractions and a base oil precursor fraction;

(c) performing a pour point reducing step to the base oil precursor fraction obtained in step (b) to produce an effluent; and, (d) separating the effluent of step (c) into two or more base oil grades.

2. The process of claim 1, wherein at least 50 wt % of compounds in the Fischer-Tropsch product have at least 30 carbon atoms.

3. The process of claim 1, wherein the weight ratio of compounds having at least 60 or more carbon atoms and compounds having at least 30 carbon atoms in the Fischer-Tropsch product is at least 0.4.

4. The process of claim 1, wherein the conversion in step (a) is between 25 wt % and 70 wt %.

5. The process of claim 1, wherein the base oil precursor fraction has an initial boiling point of between 330° C. and 400° C.

6. The process of claim 1, wherein step (c) is performed by solvent dewaxing.

7. The process of claim 1, wherein step (c) is performed by catalytic dewaxing.

8. The process of claim 7, wherein the catalytic dewaxing catalyst comprises a zeolite having a pore diameter of between 0.35 nm and 0.8 nm; a Group VIII metal; and, a binder.

9. The process of claim 8, wherein the binder is a low acidity refractory oxide binder which is essentially free of alumina and wherein the catalyst is obtained by contacting an extrudate of zeolite and binder with an aqueous solution of fluorosilicate salt.

10. The process of claim 9, wherein step (c) is performed at a temperature between 275° C. and 375° C. and a pressure of between 40 bars and 70 bars to obtain base oils having a pour point of below −60° C. and up to −10° C.

11. The process of claims 1, wherein one of the base oil grades as obtained in step (d) is a base oil having a kinematic viscosity at 100° C. of between 12 cSt and 30 cSt, a viscosity index of greater than 125 and an evaporation loss after 1 hour at 250° C. of at most 0.5 wt %.

* * * * *